US010872563B2

(12) United States Patent
Park et al.

(10) Patent No.: US 10,872,563 B2
(45) Date of Patent: Dec. 22, 2020

(54) DISPLAY APPARATUS AND METHOD OF DRIVING DISPLAY PANEL USING THE SAME

(71) Applicant: Samsung Display Co., Ltd., Yongin-si (KR)

(72) Inventors: Sehyuk Park, Seongnam-si (KR); Hyo Jin Lee, Yongin-si (KR); Hui Nam, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/360,918

(22) Filed: Mar. 21, 2019

(65) Prior Publication Data

US 2019/0340977 A1 Nov. 7, 2019

(30) Foreign Application Priority Data

May 3, 2018 (KR) ..... 10-2018-0051413

(51) Int. Cl.

| | |
|---|---|
| ***G09G 3/3233*** | (2016.01) |
| ***G09G 3/3266*** | (2016.01) |
| ***G09G 3/20*** | (2006.01) |
| ***G09G 3/3275*** | (2016.01) |

(52) U.S. Cl.

CPC ..... *G09G 3/3233* (2013.01); *G09G 3/2018* (2013.01); *G09G 3/3266* (2013.01);
(Continued)

(58) Field of Classification Search

CPC .. G09G 3/2018; G09G 3/3233; G09G 3/3266; G09G 3/3275; G09G 2300/0819;
(Continued)

(56) References Cited

U.S. PATENT DOCUMENTS 9,153,168 B2 * 10/2015 Osame ..... G09G 3/3233
9,412,303 B2 8/2016 Kim et al.
(Continued)

FOREIGN PATENT DOCUMENTS

| | | |
|---|---|---|
| JP | 2017-151300 | 8/2017 |
| KR | 10-2015-0146117 | 12/2015 |
| KR | 10-2016-0015451 | 2/2016 |
| KR | 10-2017-0038979 | 4/2017 |

*Primary Examiner* — Mihir K Rayan

(74) *Attorney, Agent, or Firm* — H.C. Park & Associates, PLC

(57) ABSTRACT

A display apparatus includes a display panel, a gate driver, a data driver, and an emission driver. The display panel includes a pixel. The pixel includes a switching element of a first type and a switching element of a second type different from the first type. The gate driver is configured to output a gate signal to the display panel. The data driver is configured to output a data voltage to the display panel. The emission driver is configured to output an emission signal. The emission signal comprises a length of an emission off duration of a writing frame in which data is written to the pixel and a length of an emission off duration of a holding frame in which the data written to the pixel is maintained in a low frequency driving mode. The length of the emission off duration of the holding frame is different from the length of the emission off duration of the writing frame in the low frequency driving mode.

21 Claims, 17 Drawing Sheets

(52) U.S. Cl.
CPC ... *G09G 3/3275* (2013.01); *G09G 2300/0819* (2013.01); *G09G 2310/08* (2013.01); *G09G 2320/0247* (2013.01); *G09G 2320/0646* (2013.01); *G09G 2320/10* (2013.01); *G09G 2330/021* (2013.01)

(58) Field of Classification Search
CPC ... G09G 2300/0842; G09G 2300/0861; G09G 2310/08; G09G 2320/0247; G09G 2320/0646; G09G 2320/10; G09G 2330/021; G09G 2340/0435
See application file for complete search history.

(56) References Cited

U.S. PATENT DOCUMENTS

| | | | | |
|---|---|---|---|---|
| 9,607,562 | B2 * | 3/2017 | Kim | G09G 3/3614 |
| 10,163,395 | B2 | 12/2018 | Nakamura | |
| 2007/0229447 | A1 * | 10/2007 | Takahara | G09G 3/3406 345/102 |
| 2008/0068312 | A1 * | 3/2008 | Kim | G09G 3/2014 345/84 |
| 2010/0109985 | A1 * | 5/2010 | Ono | G09G 3/3233 345/76 |
| 2015/0009107 | A1 * | 1/2015 | Park | G09G 3/3208 345/77 |
| 2017/0092178 | A1 * | 3/2017 | Lee | G09G 3/3233 |

* cited by examiner

FIG. 7

| GRAYSCALE | DIP | EM OFF DUTY | |
|---|---|---|---|
| | | WRITING | HOLDING |
| GRE | DIPE | ODW | ODHE |
| ⋮ | ⋮ | | ⋮ |
| GRD | DIPD | | ODHD |
| ⋮ | ⋮ | | ⋮ |
| GRC | DIPC | | ODHC |
| ⋮ | ⋮ | | ⋮ |
| GRB | DIPB | | ODHB |
| ⋮ | ⋮ | | ⋮ |
| GRA | DIPA | | ODHA |

FIG. 9

| GRAYSCALE | DIP | EM OFF DUTY | |
|---|---|---|---|
| | | WRITING | HOLDING |
| GRE | DIPE | ODWE | ODH |
| ⋮ | ⋮ | ⋮ | |
| GRD | DIPD | ODWD | |
| ⋮ | ⋮ | ⋮ | |
| GRC | DIPC | ODWC | |
| ⋮ | ⋮ | ⋮ | |
| GRB | DIPB | ODWB | |
| ⋮ | ⋮ | ⋮ | |
| GRA | DIPA | ODWA | |

FIG. 11

| GRAYSCALE | DIP | EM OFF DUTY | |
|---|---|---|---|
| | | WRITING | HOLDING |
| GRE | DIPE | ODWE | ODHE |
| ⋮ | ⋮ | ⋮ | ⋮ |
| GRD | DIPD | ODWD | ODHD |
| ⋮ | ⋮ | ⋮ | ⋮ |
| GRC | DIPC | ODWC | OHC |
| ⋮ | ⋮ | ⋮ | ⋮ |
| GRB | DIPB | ODWB | ODHB |
| ⋮ | ⋮ | ⋮ | ⋮ |
| GRA | DIPA | ODWA | ODHA |

DISPLAY APPARATUS AND METHOD OF DRIVING DISPLAY PANEL USING THE SAME

CROSS-REFERENCE TO RELATED APPLICATION

This application claims priority from and the benefit of Korean Patent Application No. 10-2018-0051413, filed May 3, 2018, which is hereby incorporated by reference for all purposes as if fully set forth herein.

BACKGROUND

Field

Exemplary embodiments generally relate to a display apparatus and a method of driving a display panel using the display apparatus, and, more particularly, to a display apparatus capable of reducing power consumption and enhancing display quality and a method of driving a display panel using the display apparatus.

Discussion

Generally, a display apparatus includes a display panel and a display panel driver. The display panel typically includes a plurality of gate lines, a plurality of data lines, a plurality of emission lines, and a plurality of pixels. The display panel driver may include a gate driver, a data driver, an emission driver, and a driving controller. The gate driver may output gate signals to the gate lines. The data driver may output data voltages to the data lines. The emission driver may output emission signals to the emission lines. The driving controller may control the gate driver, the data driver, and the emission driver.

When an image displayed via the display panel is a static image or the display panel is operated in an always on mode, a driving frequency of the display panel may be decreased to reduce a power consumption. When the driving frequency of the display panel is decreased, a flicker may be shown to (or perceived by) a user due to a leakage current or a luminance difference between a writing frame and a holding frame.

The above information disclosed in this section is only for understanding the background of the inventive concepts, and, therefore, may contain information that does not form prior art.

SUMMARY

Some exemplary embodiments provide a display apparatus capable of reducing a power consumption and enhancing a display quality.

Some exemplary embodiments provide a method of driving a display panel using the display apparatus.

Additional aspects will be set forth in the detailed description which follows, and, in part, will be apparent from the disclosure, or may be learned by practice of the inventive concepts.

According to some exemplary embodiments, a display apparatus includes a display panel, a gate driver, a data driver, and an emission driver. The display panel includes a pixel. The pixel includes a switching element of a first type and a switching element of a second type different from the first type. The gate driver is configured to output a gate signal to the display panel. The data driver is configured to output a data voltage to the display panel. The emission driver is configured to output an emission signal. The emission signal comprises a length of an emission off duration of a writing frame in which data is written to the pixel and a length of an emission off duration of a holding frame in which the data written to the pixel is maintained in a low frequency driving mode. The length of the emission off duration of the holding frame is different from the length of the emission off duration of the writing frame in the low frequency driving mode.

According to some exemplary embodiments, a method of driving a display panel includes: outputting a first data writing gate signal to a display panel; outputting a second data writing gate signal to the display panel simultaneously with the first data writing gate signal; outputting a data voltage to the display panel; and outputting an emission signal to the display panel. The display panel includes a pixel. The pixel includes a switching element of a first type and a switching element of a second type different from the first type. The emission signal includes a length of an emission off duration of a writing frame in which data is written to the pixel and a length of an emission off duration of a holding frame in which the data written to the pixel is maintained in a low frequency driving mode. The length of the emission off duration of the holding frame is different from the length of the emission off duration of the writing frame in the low frequency driving mode.

According to various exemplary embodiments, a length of an emission off duration of a writing frame may be different from a length of an emission off duration of a holding frame in a low frequency driving mode so that flicker of the display panel may be prevented. The flicker of the display panel is prevented in the low frequency driving mode so that the power consumption of the display apparatus may be reduced and the display quality of the display panel may be enhanced.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

FIG. 7 is a table illustrating a length of the emission off duration adjusted by a driving controller or an emission driver of FIG. 1 according to grayscales according to some exemplary embodiments.

FIG. 9 is a table illustrating a length of the emission off duration adjusted by the driving controller or the emission driver of FIG. 1 according to grayscales according to some exemplary embodiments.

FIG. 11 is a table illustrating a length of the emission off duration adjusted by the driving controller or the emission driver of FIG. 1 according to grayscales according to some exemplary embodiments.

DETAILED DESCRIPTION OF THE ILLUSTRATED EMBODIMENTS

Figure 1:
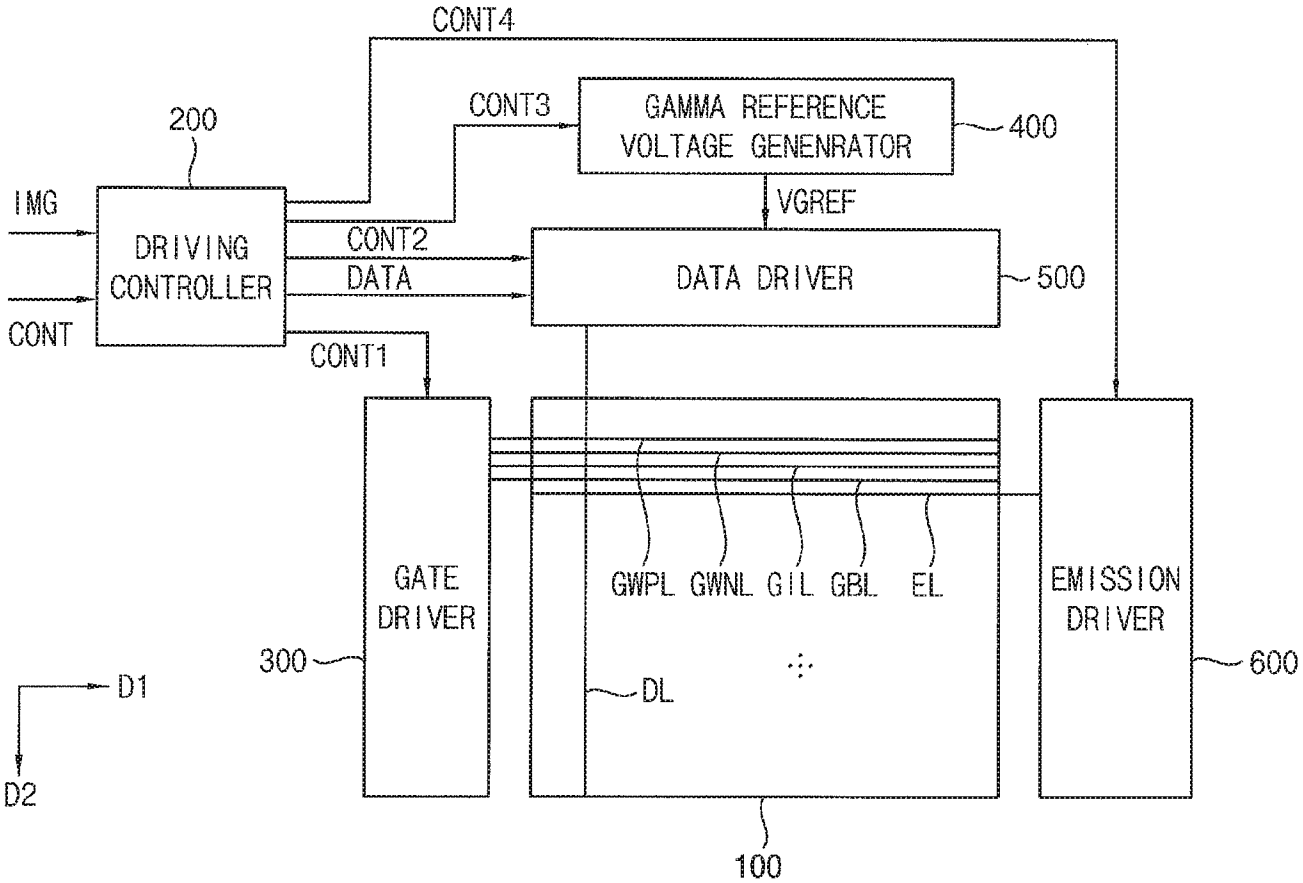
FIG. 1 is a block diagram illustrating a display apparatus according to some exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

In the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the inventive concepts. Further, the blocks, units, and/or modules of some exemplary embodiments may be physically combined into more complex blocks, units, and/or modules without departing from the inventive concepts.

Hereinafter, various exemplary embodiments will be explained in detail with reference to the accompanying drawings.

FIG. 1 is a block diagram illustrating a display apparatus according to some exemplary embodiments.

Referring to FIG. 1, the display apparatus includes a display panel 100 and a display panel driver. The display panel driver includes a driving controller 200, a gate driver 300, a gamma reference voltage generator 400, a data driver 500, and an emission driver 600.

The display panel 100 has a display region on (or in) which an image is displayed and a peripheral region adjacent to the display region.

The display panel 100 includes a plurality of gate lines GWPL, GWNL, GIL and GBL, a plurality of data lines DL, a plurality of emission lines EL, and a plurality of pixels electrically connected to the gate lines GWPL, GWNL, GIL and GBL, the data lines DL, and the emission lines EL. The gate lines GWPL, GWNL, GIL and GBL may extend in a first direction D1, the data lines DL may extend in a second direction D2 crossing the first direction D1, and the emission lines EL may extend in the first direction D1; however, exemplary embodiments are not limited thereto.

The driving controller 200 receives input image data IMG and an input control signal CONT from an external apparatus (not shown). For example, the input image data IMG may include red image data, green image data, and blue image data. The input image data IMG may include white image data. The input image data IMG may include magenta image data, cyan image data, and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4, and a data signal DATA (not shown) based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GWPL, GWNL, GIL and GBL in response to the first control signal CONT1 received from the driving controller 200. The gate driver 300 may sequentially output the gate signals to the gate lines GWPL, GWNL, GIL and GBL.

The gamma reference voltage generator 400 generates one or more gamma reference voltages VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In some exemplary embodiments, the gamma reference voltage generator 400 may be disposed in (or as part of) the driving controller 200 or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

Figure 2:
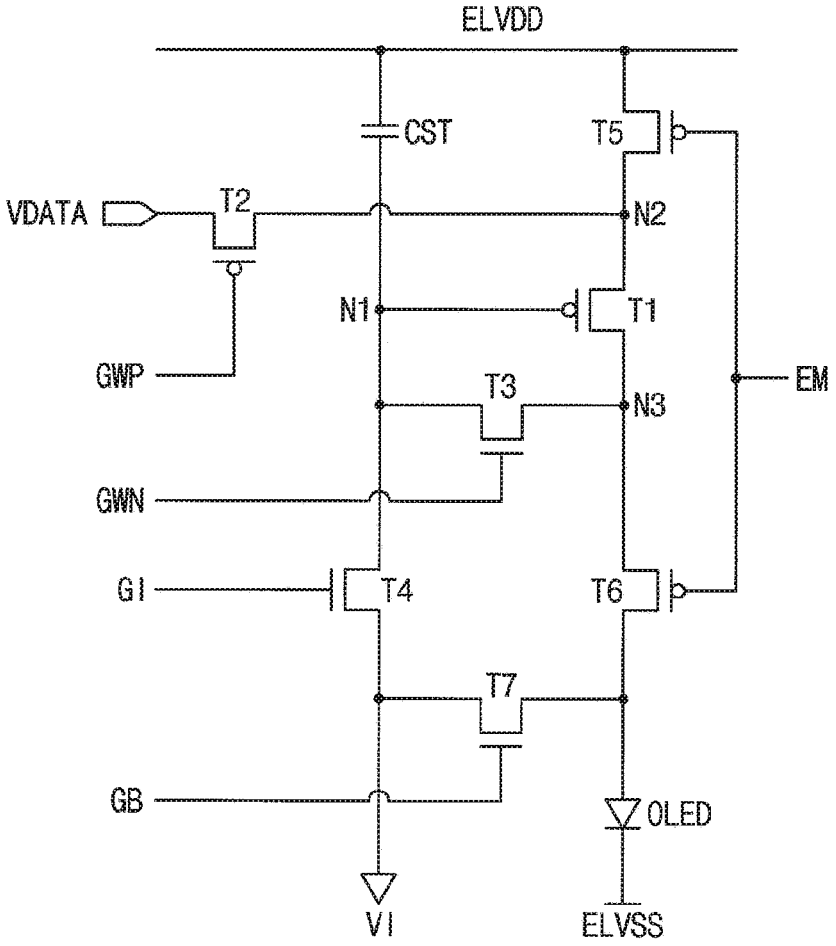
FIG. 2 is a circuit diagram illustrating a pixel of a display panel of FIG. 1 according to some exemplary embodiments.
Figure 3:
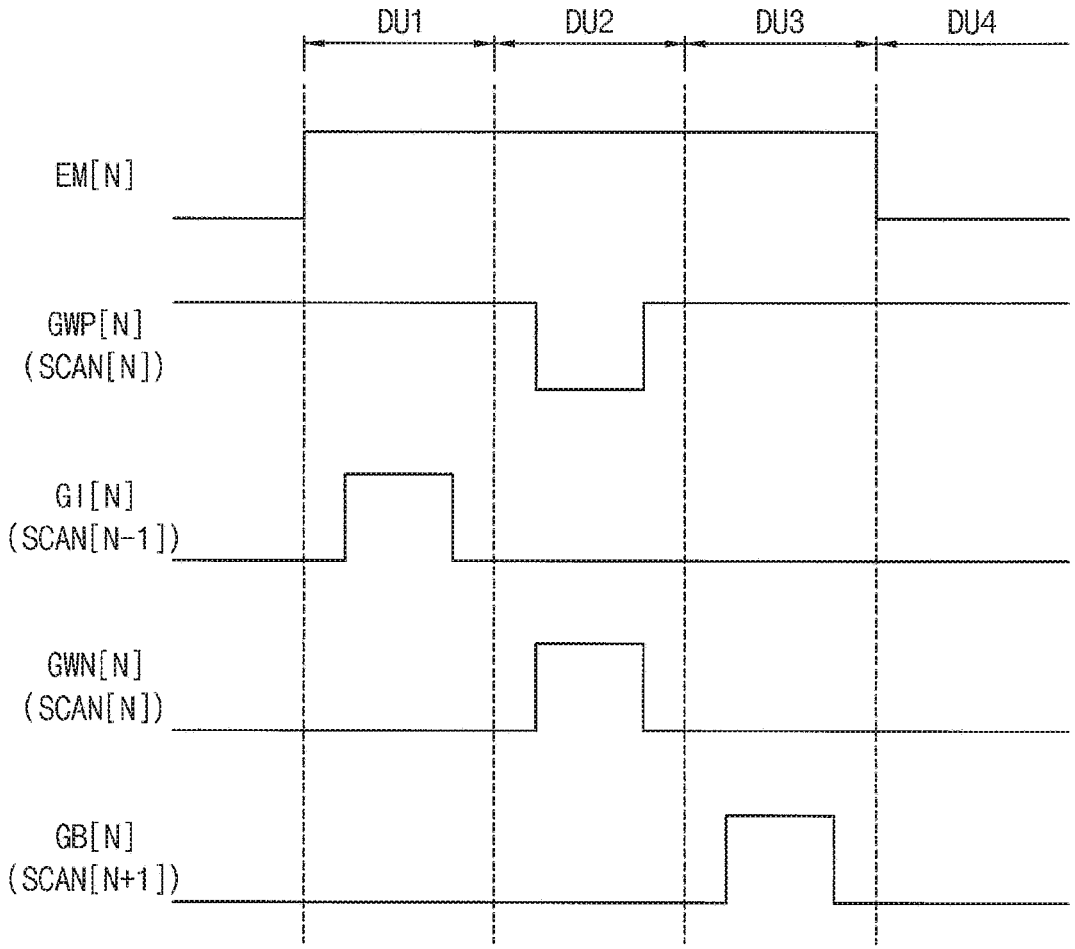
FIG. 3 is a timing diagram illustrating input signals applied to the pixel of FIG. 2 according to some exemplary embodiments.

FIG. 2 is a circuit diagram illustrating a pixel of the display panel 100 of FIG. 1 according to some exemplary embodiments. FIG. 3 is a timing diagram illustrating input signals applied to the pixel of FIG. 2 according to some exemplary embodiments.

Referring to FIGS. 1 to 3, the display panel 100 includes the plurality of the pixels. Each pixel includes an organic light emitting element OLED.

The pixel receives first and second data write gate signals GWP and GWN, a data initialization gate signal GI, an organic light emitting element initialization gate signal GB, the data voltage VDATA and the emission signal EM, and the organic light emitting element OLED of the pixel emits light corresponding to the level of the data voltage VDATA to display the image.

According to some exemplary embodiments, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

For example, the data write gate signal may include a first data write gate signal GWP and a second data write gate signal GWN. The first data write gate signal GWP may be applied to the P-type transistor so that the first data write gate signal GWP has an activation signal of a low level corresponding to a data writing timing. The second data write gate signal GWN may be applied to the N-type transistor so that the second data write gate signal GWN has an activation signal of a high level corresponding to the data writing timing.

At least one of the pixels may include first to seventh pixel switching elements T1 to T7, a storage capacitor CST, and the organic light emitting element OLED.

The first pixel switching element T1 includes a control electrode connected to a first node N1, an input electrode connected to a second node N2 and an output electrode connected to a third node N3.

For example, the first pixel switching element T1 may be the polysilicon thin film transistor. For example, the first pixel switching element T1 may be the P-type thin film transistor. The control electrode of the first pixel switching element T1 may be a gate electrode, the input electrode of the first pixel switching element T1 may be a source electrode, and the output electrode of the first pixel switching element T1 may be a drain electrode.

The second pixel switching element T2 includes a control electrode to which the first data write gate signal GWP is applied, an input electrode to which the data voltage VDATA is applied, and an output electrode connected to the second node N2.

For example, the second pixel switching element T2 may be the polysilicon thin film transistor. For example, the second pixel switching element T2 may be the P-type thin film transistor. The control electrode of the second pixel switching element T2 may be a gate electrode, the input electrode of the second pixel switching element T2 may be a source electrode, and the output electrode of the second pixel switching element T2 may be a drain electrode.

The third pixel switching element T3 includes a control electrode to which the second data write gate signal GWN is applied, an input electrode connected to the first node N1, and an output electrode connected to the third node N3.

For example, the third pixel switching element T3 may be the oxide thin film transistor. For example, the third pixel switching element T3 may be the N-type thin film transistor. The control electrode of the third pixel switching element T3 may be a gate electrode, the input electrode of the third pixel switching element T3 may be a source electrode, and the output electrode of the third pixel switching element T3 may be a drain electrode.

The fourth pixel switching element T4 includes a control electrode to which the data initialization gate signal GI is applied, an input electrode to which an initialization voltage VI is applied, and an output electrode connected to the first node N1.

For example, the fourth pixel switching element T4 may be the oxide thin film transistor. For example, the fourth pixel switching element T4 may be the N-type thin film transistor. The control electrode of the fourth pixel switching element T4 may be a gate electrode, the input electrode of the fourth pixel switching element T4 may be a source electrode, and the output electrode of the fourth pixel switching element T4 may be a drain electrode.

The fifth pixel switching element T5 includes a control electrode to which the emission signal EM is applied, an input electrode to which a high power voltage ELVDD is applied, and an output electrode connected to the second node N2.

For example, the fifth pixel switching element T5 may be the polysilicon thin film transistor. For example, the fifth pixel switching element T5 may be the P-type thin film transistor. The control electrode of the fifth pixel switching element T5 may be a gate electrode, the input electrode of the fifth pixel switching element T5 may be a source electrode, and the output electrode of the fifth pixel switching element T5 may be a drain electrode.

The sixth pixel switching element T6 includes a control electrode to which the emission signal EM is applied, an input electrode connected to the third node N3, and an output electrode connected to an anode electrode of the organic light emitting element OLED.

For example, the sixth pixel switching element T6 may be the polysilicon thin film transistor. For example, the sixth pixel switching element T6 may be a P-type thin film transistor. The control electrode of the sixth pixel switching element T6 may be a gate electrode, the input electrode of the sixth pixel switching element T6 may be a source electrode and the output electrode of the sixth pixel switching element T6 may be a drain electrode.

The seventh pixel switching element T7 includes a control electrode to which the organic light emitting element initialization gate signal GB is applied, an input electrode to which the initialization voltage VI is applied, and an output electrode connected to the anode electrode of the organic light emitting element OLED.

For example, the seventh pixel switching element T7 may be the oxide thin film transistor. For example, the seventh pixel switching element T7 may be the N-type thin film transistor. The control electrode of the seventh pixel switching element T7 may be a gate electrode, the input electrode of the seventh pixel switching element T7 may be a source electrode, and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode connected to the output electrode of the sixth switching element T6 and a cathode electrode to which a low power voltage ELVSS is applied.

In FIG. 3, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. During a third duration DU3, the anode electrode of the organic light emitting element OLED is initialized in response to the organic light emitting element initialization gate signal GB. During a fourth duration DU4, the organic light emitting element OLED emits the light in response to the emission signal EM so that the display panel 100 displays the image.

Although an emission off duration of the emission signal EM corresponds to first to third durations DU1, DU2 and DU3 in FIG. 2, exemplary embodiments are not limited thereto. The emission off duration of the emission signal EM may be set to include the data writing duration DU2. The emission off duration of the emission signal EM may be longer than a sum of the first to third durations DU1, DU2, and DU3.

During the first duration DU1, the data initialization gate signal GI may have an active level. For example, the active level of the data initialization gate signal GI may be a high level. When the data initialization gate signal GI has the active level, the fourth pixel switching element T4 is turned on so that the initialization voltage VI may be applied to the first node N1. The data initialization gate signal GI[N] of a present stage may be generated based on a scan signal SCAN[N−1] of a previous stage.

During the second duration DU2, the first data write gate signal GWP and the second data write gate signal GWN may have an active level. For example, the active level of the first data write gate signal GWP may be a low level and the active level of the second data write gate signal GWN may be a high level. When the first data write gate signal GWP and the second data writhe gate signal GWN have the active level, the second pixel switching element T2 and the third pixel switching element T3 are turned on. In addition, the first pixel switching element T1 is turned on in response to the initialization voltage VI. The first data write gate signal GWP[N] of the present stage may be generated based on a scan signal SCAN[N] of the present stage. The second data write gate signal GWN[N] of the present stage may be generated based on the scan signal SCAN[N] of the present stage.

A voltage, which is a subtraction of an absolute value |VTH| of the threshold voltage of the first pixel switching element T1 from the data voltage VDATA, may be charged at the first node N1 along a path generated by the first to third pixel switching elements T1, T2 and T3.

During the third duration DU3, the organic light emitting element initialization gate signal GB may have an active level. For example, the active level of the organic light emitting element initialization gate signal GB may be a high level. When the organic light emitting element initialization gate signal GB has the active level, the seventh pixel switching element T7 is turned on so that the initialization voltage VI may be applied to the anode electrode of the organic light emitting element OLED. The organic light emitting element initialization gate signal GB [N] of the present stage may be generated based on a scan signal SCAN[N+1] of a next stage.

During the fourth duration DU4, the emission signal EM may have an active level. The active level of the emission signal EM may be a low level. When the emission signal EM has the active level, the fifth pixel switching element T5 and the sixth pixel switching element T6 are turned on. In addition, the first pixel switching element T1 is turned on by the data voltage VDATA.

A driving current flows through the fifth pixel switching element T5, the first pixel switching element T1, and the sixth pixel switching element T6 to drive the organic light emitting element OLED. An intensity of the driving current may be determined by the level of the data voltage VDATA. A luminance of the organic light emitting element OLED is determined by the intensity of the driving current. The driving current ISD flowing through a path from the input electrode to the output electrode of the first pixel switching element T1 is determined as follows according to Equation 1.

$$ISD = \frac{1}{2}\mu Cox\frac{W}{L}(VSG - |VTH|)^2 \quad \text{Equation 1}$$

In Equation 1, μ is a mobility of the first pixel switching element T1. Cox is a capacitance per unit area of the first pixel switching element T1. W/L is a width to length ratio of the first pixel switching element T1. VSG is a voltage between the input electrode N2 of the first pixel switching element T1 and the control node N1 of the first pixel switching element T1. |VTH| is the threshold voltage of the first pixel switching element T1.

The voltage VG of the first node N1 after the compensation of the threshold voltage |VTH| during the second duration DU2 may be represented as follows according to Equation 2.

$$VG = VDATA - |VTH| \quad \text{Equation 2}$$

When the organic light emitting element OLED emits the light during the fourth duration DU4, the driving voltage VOV and the driving current ISD may be represented as following according to Equations 3 and 4. In Equation 3, VS is a voltage of the second node N2.

$$VOV = VS - VG - |VTH| = ELVDD - (VDATA - |VTH|) - |VTH| = ELVDD - VDATA \quad \text{Equation 3}$$

$$ISD = \frac{1}{2}\mu Cox\frac{W}{L}(ELVDD - VDATA)^2 \quad \text{Equation 4}$$

The threshold voltage |VTH| is compensated during the second duration DU2 so that the driving current ISD may be determined regardless of the threshold voltage |VTH| of the first pixel switching element T1 when the organic light emitting element OLED emits the light during the fourth duration DU4.

According to some exemplary embodiments, when the image displayed via the display panel 100 is a static image or the display panel is operated in an always on mode, a driving frequency of the display panel 100 may be decreased to reduce power consumption. When all of the switching elements of the pixel of the display panel 100 are polysilicon thin film transistors, a flicker may be generated due to a leakage current of the pixel switching elements in the low frequency driving mode. Thus, some of the pixel switching elements may be designed using the oxide thin film transistors. In some exemplary embodiments, the third pixel switching element T3, the fourth pixel switching element T4, and the seventh pixel switching element T7 may be the oxide thin film transistors. The first pixel switching element T1, the second pixel switching element T2, the fifth pixel switching element T5, and the sixth pixel switching element T6 may be the polysilicon thin film transistors.

Figure 4:
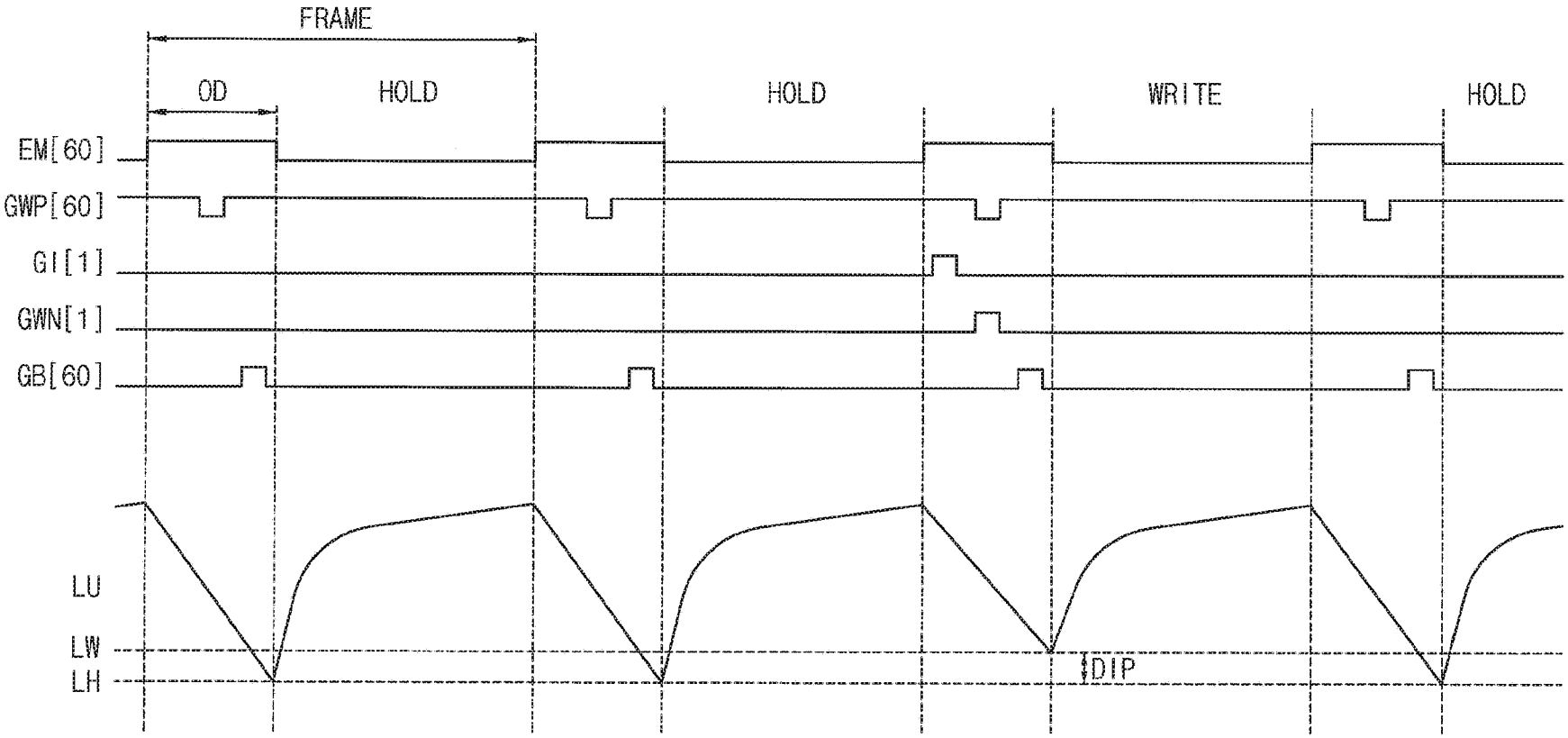
FIG. 4 is a timing diagram illustrating input signals applied to the pixels of the display panel of FIG. 1 in a low frequency driving mode and a luminance of an image displayed via the display panel of FIG. 1 according to some exemplary embodiments.
Figure 5:
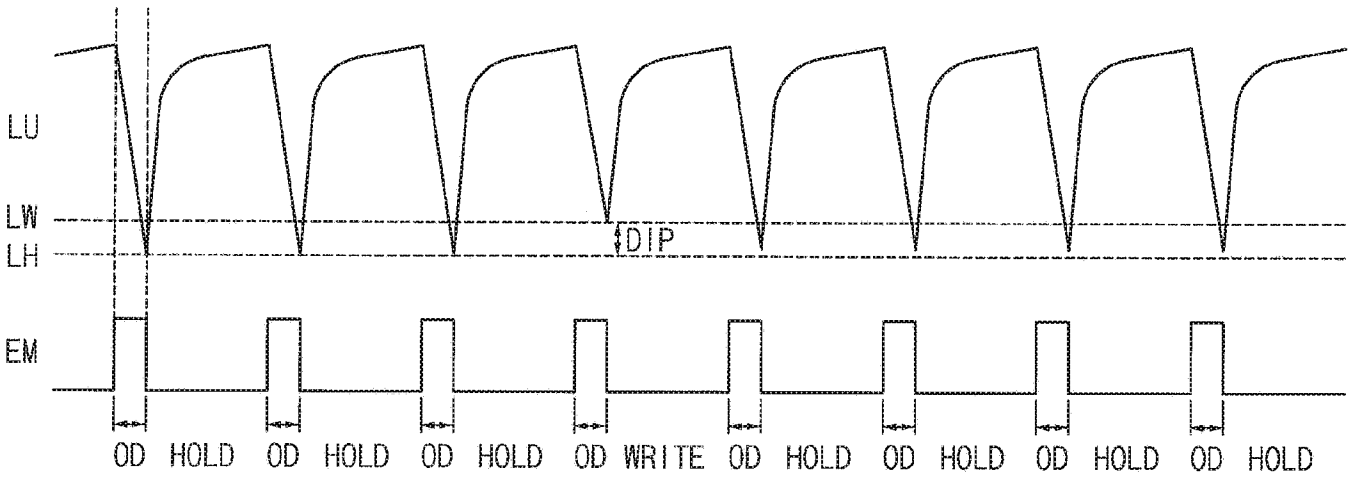
FIG. 5 is a timing diagram illustrating a luminance of an image displayed via the display panel of FIG. 1 when a length of an emission off duration of an emission signal is not adjusted in the low frequency driving mode according to some exemplary embodiments.

FIG. 4 is a timing diagram illustrating input signals applied to the pixels of the display panel 100 of FIG. 1 in the low frequency driving mode and a luminance of an image displayed via the display panel 100 of FIG. 1 according to some exemplary embodiments. FIG. 5 is a timing diagram illustrating a luminance of an image displayed via the display panel 100 of FIG. 1 when a length of an emission off duration of the emission signal EM is not adjusted in the low frequency driving mode according to some exemplary embodiments.

Referring to FIGS. 1 to 5, the display panel 100 may be driven in a normal driving mode in which the display panel 100 is driven in a normal driving frequency and in a low frequency driving mode in which the display panel 100 is driven in a frequency less than the normal driving frequency.

For example, when the input image data represents a video image, the display panel 100 may be driven in the normal driving mode. For example, when the input image data IMG represents a static image, the display panel 100 may be driven in the low frequency driving mode. For example, when the display apparatus is operated in the always on mode, the display panel 100 may be driven in the low frequency driving mode.

The display panel 100 may be driven in a unit of a frame. The display panel 100 may be refreshed in every frame in the normal driving mode. Thus, the normal driving mode includes only writing frames in which the data is written in (or to) the pixel(s).

The display panel 100 may be refreshed in the frequency of the low frequency driving mode in the low frequency driving mode. Thus, the low frequency driving mode includes the writing frames in which the data is written in the pixel and holding frames in which the written data is maintained without writing the data in the pixel.

For example, when the frequency of the normal driving mode is 60 Hz and the frequency of the low frequency driving mode is 1 Hz, the low frequency driving mode includes one writing frame and fifty nine holding frames in a second. For example, when the frequency of the normal driving mode is 60 Hz and the frequency of the low frequency driving mode is 1 Hz, fifty nine continuous holding frames are disposed between two adjacent writing frames.

For example, when the frequency of the normal driving mode is 60 Hz and the frequency of the low frequency driving mode is 10 Hz, the low frequency driving mode includes ten writing frame and fifty holding frames in a second. For example, when the frequency of the normal driving mode is 60 Hz and the frequency of the low frequency driving mode is 10 Hz, five continuous holding frames are disposed between two adjacent writing frames.

According to some exemplary embodiments, the second data writing gate signal GWN and the data initialization gate signal GI may have a first frequency in the low frequency driving mode. The first frequency may be the frequency of the low frequency driving mode. In contrast, the first data writing gate signal GWP, the emission signal EM, and the organic light emitting element initialization gate signal GB may have a second frequency greater than the first frequency. The second frequency may be the normal frequency of the normal driving mode. As seen in FIG. 4, the first frequency is 1 Hz and the second frequency is 60 Hz.

FIGS. 4 and 5 illustrate the holding frames and the writing frame disposed between the holding frames and luminance profile LU of the display panel 100 in the holding frames and the writing frame. The frame may include an emission off duration OD when the emission signal EM has the inactive level and an emission on duration when the emission signal EM has the active level. The luminance of the display panel 100 decreases in the emission off duration OD and increases to represent a target luminance level in the emission on duration.

As seen in FIGS. 4 and 5, the length of the emission off duration OD of the holding frame may be substantially the same as the length of the emission off duration OD of the writing frame in the low frequency driving mode. In this case, a lowest level LH of the luminance in the emission off duration OD of the holding frame may be different from a lowest level LW of the luminance in the emission off duration OD of the writing frame. In the low frequency driving mode, the difference between the lowest level LH of the luminance in the emission off duration OD of the holding frame and the lowest level LW of the luminance in the emission off duration OD of the writing frame may be generated due to physical characteristics of the pixel switching elements and the driving characteristics of the display apparatus.

For example, the lowest level LH of the luminance in the emission off duration OD of the holding frame may be less than the lowest level LW of the luminance in the emission off duration OD of the writing frame. The difference DIP between the lowest level LH of the luminance in the emission off duration OD of the holding frame and the lowest level LW of the luminance in the emission off duration OD of the writing frame may generate the flicker that is perceivable to a user.

Figure 6:
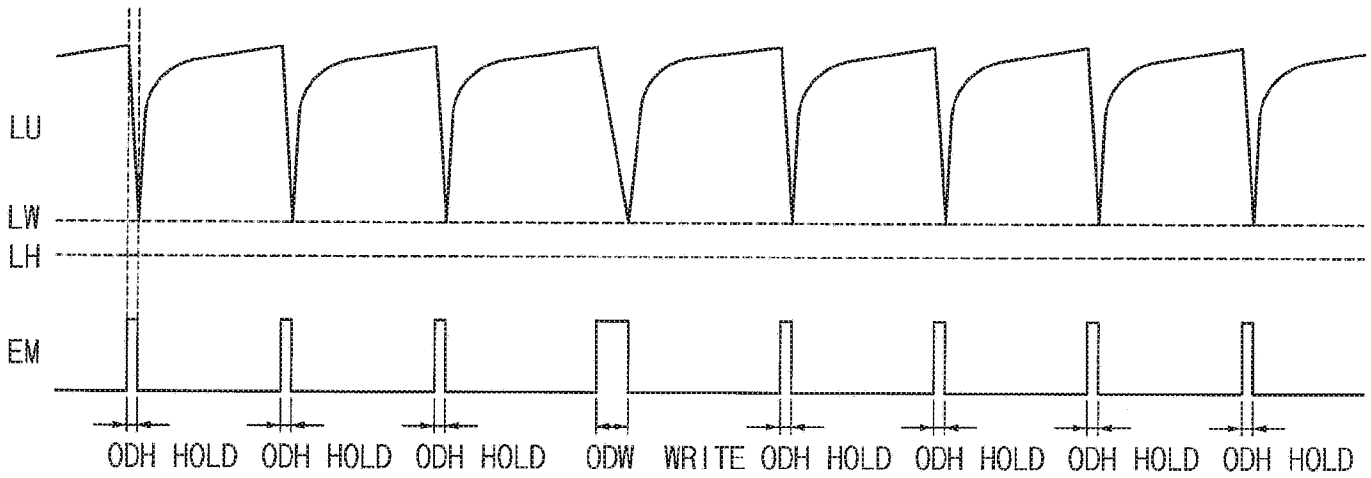
FIG. 6 is a timing diagram illustrating a luminance of an image displayed via the display panel of FIG. 1 when a length of the emission off duration of the emission signal is adjusted in the low frequency driving mode according to some exemplary embodiments.

FIG. 6 is a timing diagram illustrating a luminance of an image displayed via the display panel 100 of FIG. 1 when a length of the emission off duration of the emission signal EM is adjusted in the low frequency driving mode according to some exemplary embodiments. FIG. 7 is a table illustrating a length of the emission off duration adjusted by the driving controller 200 or the emission driver 600 of FIG. 1 according to grayscales according to some exemplary embodiments.

Referring to FIGS. 1 to 7, the emission driver 600 may generate the emission signal EM having the length of the emission off duration ODW of the writing frame in which the data is written to the pixel and the length of the emission off duration ODH of the holding frame in which the data written to the pixel is maintained different from the emission off duration ODW of the writing frame in the low frequency driving mode. The emission driver 600 may output the emission signal EM having the adjusted length of the emission off duration to the display panel 100 in the low frequency driving mode. In contrast, the emission driver 600 may output the emission signal EM having uniform lengths of the emission off duration to the display panel 100 in the normal driving mode.

For example, as shown in FIG. 6, the length of the emission off duration ODW of the writing frame may be greater than the length of the emission off duration ODH of the holding frame in the low frequency driving mode.

The length of the emission off duration ODW of the writing frame of the low frequency driving mode may be substantially the same as the length of the emission off duration of the writing frame of the normal driving mode. The length of the emission off duration ODH of the holding frame of the low frequency driving mode may be adjusted to be less than the length of the emission off duration of the writing frame of the normal driving mode. Thus, the lowest luminance of the writing frame and the lowest luminance of the holding frame in the low driving frequency mode may be adjusted to be uniform. The lowest luminance of the writing frame and the lowest luminance of the holding frame in the low driving frequency mode may be substantially the same as the lowest luminance LW of the writing frame before adjustment.

In some exemplary embodiments, the length of the emission off duration may be adjusted by the driving controller 200. In some exemplary embodiments, the length of the emission off duration may be adjusted by the emission driver 600.

Referring to FIG. 7, the length of the emission off duration ODH of the holding frame of the low frequency driving mode may be adjusted differently according to the grayscale of the input image. Degree of the flicker of the display panel 100 may be determined by the difference DIPA, DIPB, DIPC, DIPD, and DIPE between the lowest luminance LW of the writing frame and the lowest luminance LH of the holding frame in the low frequency driving mode. In addition, the difference DIPA, DIPB, DIPC, DIPD, and DIPE between the lowest luminance LW of the writing frame and the lowest luminance LH of the holding frame in the low frequency driving mode may vary according to the grayscale GRA, GRB, GRC, GRD, and GRE of the input image of the display panel 100.

In some exemplary embodiments, the length of the emission off duration ODW of the writing frame may be maintained regardless of the grayscale in the low driving frequency mode. However, the length of the emission off duration ODHA, ODHB, ODHC, ODHD, and ODHE of the holding frame may be adjusted to vary according to the grayscale GRA, GRB, GRC, GRD, and GRE in the low driving frequency mode.

In addition, the length of the emission off duration ODHA, ODHB, ODHC, ODHD, and ODHE of the holding frame in the low frequency driving mode may be adjusted to vary according to the frequency of the low frequency driving mode. The degree of the flicker of the display panel 100 may be determined by the difference DIP between the lowest luminance LW of the writing frame and the lowest luminance LH of the holding frame in the low frequency driving mode. In addition, the difference DIP between the lowest luminance LW of the writing frame and the lowest luminance LH of the holding frame in the low frequency driving mode may vary according to the frequency of the low frequency driving mode.

In some exemplary embodiments, the length of the emission off duration ODW of the writing frame may be maintained regardless of the frequency in the low driving frequency mode. However, the length of the emission off duration ODH of the holding frame may be adjusted to vary according to the frequency in the low driving frequency mode.

For example, when the degree of the flicker of the display panel 100 is great, the difference between the length of the writing frame of the emission off duration ODW and the length of the holding frame of the emission off duration ODH may be great.

According to some exemplary embodiments, the length of the emission off duration of the writing frame ODW and the length of the emission off duration of the holding frame ODH may be adjusted to be different from each other in the low frequency driving mode so that the flicker of the display panel 100 may be prevented. The flicker of the display panel 100 may be prevented so that the power consumption of the display apparatus may be reduced and the display quality of the display panel 100 may be enhanced.

Figure 8:
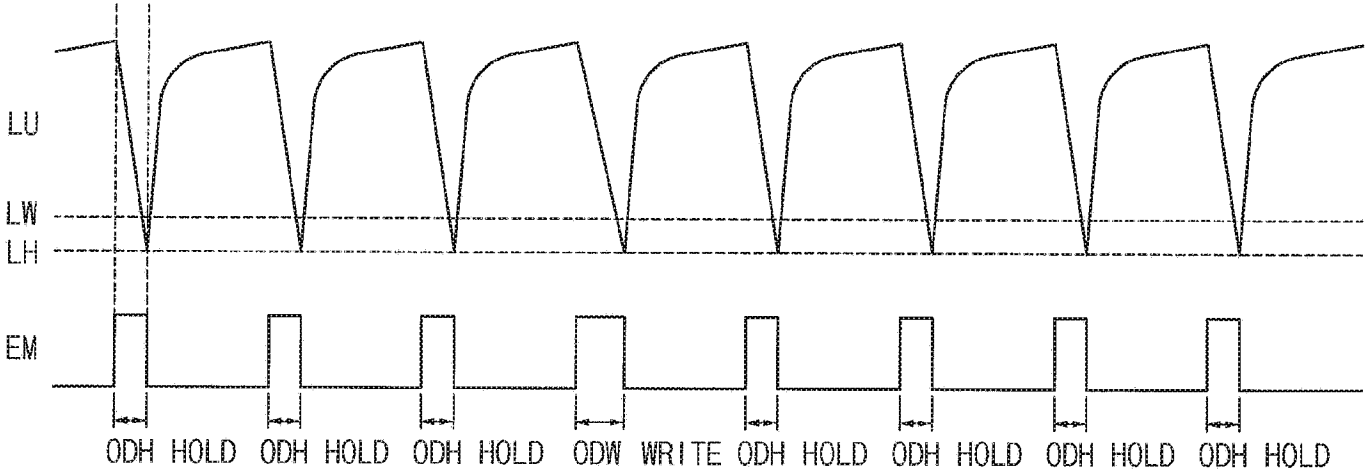
FIG. 8 is a timing diagram illustrating a luminance of an image displayed via the display panel of FIG. 1 when a length of the emission off duration of the emission signal is adjusted in the low frequency driving mode according to some exemplary embodiments.

FIG. 8 is a timing diagram illustrating a luminance of an image displayed via the display panel 100 of FIG. 1 when a length of the emission off duration of the emission signal EM adjusted in the low frequency driving mode according to some exemplary embodiments. FIG. 9 is a table illustrating a length of the emission off duration adjusted by the driving controller 200 or the emission driver 600 of FIG. 1 according to grayscales according to some exemplary embodiments.

The display apparatus and the method of driving the display panel according to various exemplary embodiments of FIGS. 8 and 9 are substantially the same as the display apparatus and the method of driving the display panel of the various exemplary embodiments described in association with FIGS. 1 to 7, except for the method of adjusting the length of the emission off duration. Thus, the same reference numerals will be used to refer to the same or like parts as those previously described in association with FIGS. 1 to 7 and any repetitive explanation concerning the above elements will be omitted.

Referring to FIGS. 1 to 5, 8, and 9, the display apparatus includes a display panel 100 and a display panel driver. The display panel driver includes a driving controller 200, a gate driver 300, a gamma reference voltage generator 400, a data driver 500, and an emission driver 600.

The display panel 100 includes the plurality of the pixels. Each pixel includes an organic light emitting element OLED.

The pixel receives a data write gate signal (e.g., first and second data write gate signals GWP and GWN), a data initialization gate signal GI, an organic light emitting element initialization gate signal GB, the data voltage VDATA, and the emission signal EM and the organic light emitting element OLED of the pixel emits light corresponding to the level of the data voltage VDATA to display the image.

The display panel 100 may be driven in a normal driving mode in which the display panel 100 is driven in a normal driving frequency and in a low frequency driving mode in which the display panel 100 is driven in a frequency less than the normal driving frequency.

In FIGS. 4 and 5, the length of the emission off duration OD of the holding frame may be substantially the same as the length of the emission off duration OD of the writing frame in the low frequency driving mode. In this case, a lowest level LH of the luminance in the emission off duration OD of the holding frame may be different from a lowest level LW of the luminance in the emission off duration OD of the writing frame.

According to some exemplary embodiments, the emission driver 600 may generate the emission signal EM having the length of the emission off duration ODW of the writing frame in which the data is written to the pixel and the length of the emission off duration ODH of the holding frame in which the data written to the pixel is maintained different from the emission off duration ODW of the writing frame in the low frequency driving mode. The emission driver 600 may output the emission signal EM having the adjusted length of the emission off duration to the display panel 100 in the low frequency driving mode. In contrast, the emission driver 600 may output the emission signal EM having uniform lengths of the emission off duration to the display panel 100 in the normal driving mode.

For example, as shown in FIG. 8, the length of the emission off duration ODW of the writing frame may be greater than the length of the emission off duration ODH of the holding frame in the low frequency driving mode.

The length of the emission off duration ODH of the holding frame of the low frequency driving mode may be substantially the same as the length of the emission off duration of the writing frame of the normal driving mode. The length of the emission off duration ODW of the writing frame of the low frequency driving mode may be adjusted to be greater than the length of the emission off duration of the writing frame of the normal driving mode. Thus, the lowest luminance of the writing frame and the lowest luminance of the holding frame in the low driving frequency mode may be adjusted to be uniform. The lowest luminance of the writing frame and the lowest luminance of the holding frame in the low driving frequency mode may be substantially the same as the lowest luminance LH of the holding frame before adjustment.

In some exemplary embodiments, the length of the emission off duration may be adjusted by the driving controller 200. In some exemplary embodiments, the length of the emission off duration may be adjusted by the emission driver 600.

Referring to FIG. 9, the length of the emission off duration ODW of the writing frame of the low frequency driving mode may be adjusted differently according to the grayscale of the input image. A degree of the flicker of the display panel 100 may be determined by the difference DIPA, DIPB, DIPC, DIPD, and DIPE between the lowest luminance LW of the writing frame and the lowest luminance LH of the holding frame in the low frequency driving mode. In addition, the difference DIPA, DIPB, DIPC, DIPD, and DIPE between the lowest luminance LW of the writing frame and the lowest luminance LH of the holding frame in the low frequency driving mode may vary according to the grayscale GRA, GRB, GRC, GRD, and GRE of the input image of the display panel 100.

In some exemplary embodiments, the length of the emission off duration ODH of the holding frame may be maintained regardless of the grayscale in the low driving frequency mode. However, the length of the emission off duration ODWA, ODWB, ODWC, ODWD, and ODWE of the writing frame may be adjusted to vary according to the grayscale GRA, GRB, GRC, GRD, and GRE in the low driving frequency mode.

In addition, the length of the emission off duration ODWA, ODWB, ODWC, ODWD, and ODWE of the writing frame in the low frequency driving mode may be adjusted to vary according to the frequency of the low frequency driving mode. The degree of the flicker of the display panel 100 may be determined by the difference DIP between the lowest luminance LW of the writing frame and the lowest luminance LH of the holding frame in the low frequency driving mode. In addition, the difference DIP between the lowest luminance LW of the writing frame and the lowest luminance LH of the holding frame in the low frequency driving mode may vary according to the frequency of the low frequency driving mode.

In some exemplary embodiments, the length of the emission off duration ODH of the holding frame may be maintained regardless of the frequency in the low driving frequency mode. However, the length of the emission off duration ODW of the writing frame may be adjusted to vary according to the frequency in the low driving frequency mode.

For example, when the degree of the flicker of the display panel 100 is great, the difference between the length of the writing frame of the emission off duration ODW and the length of the holding frame of the emission off duration ODH may be great. However, in some exemplary embodiments, the length of the emission off duration of the writing frame and the length of the emission off duration of the holding frame may be adjusted to be different from each other in the low frequency driving mode so that the flicker of the display panel 100 may be prevented. The flicker of the display panel 100 is prevented so that the power consumption of the display apparatus may be reduced and the display quality of the display panel 100 may be enhanced.

Figure 10:
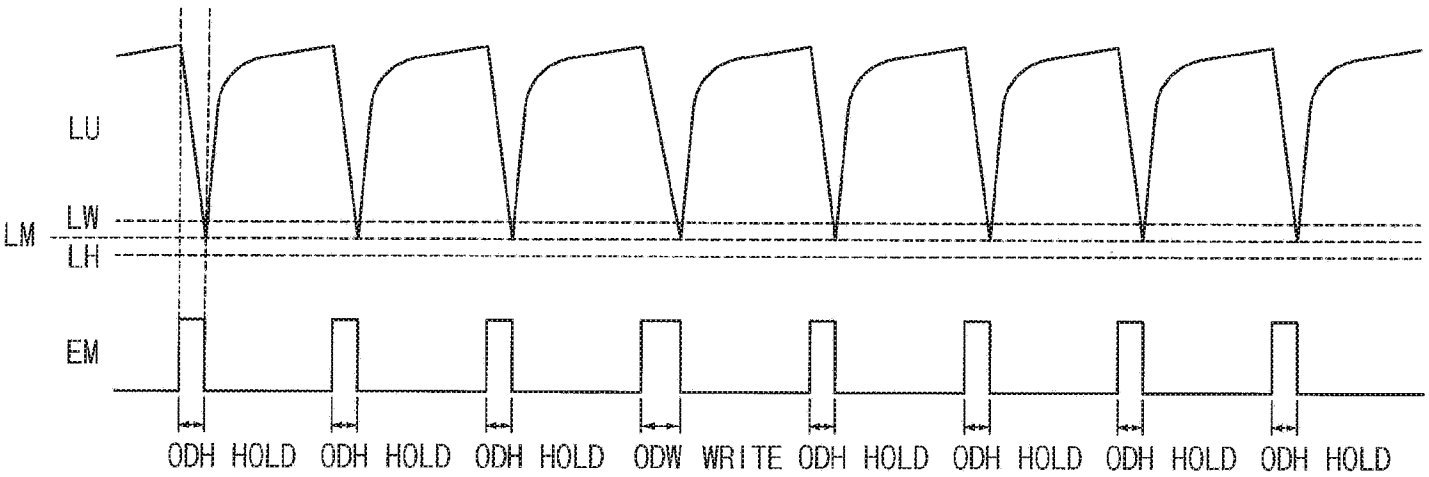
FIG. 10 is a timing diagram illustrating a luminance of an image displayed via the display panel of FIG. 1 when a length of the emission off duration of the emission signal is adjusted in the low frequency driving mode according to some exemplary embodiments.

FIG. 10 is a timing diagram illustrating a luminance of an image displayed via the display panel 100 of FIG. 1 when a length of the emission off duration of the emission signal EM is adjusted in the low frequency driving mode according to some exemplary embodiments. FIG. 11 is a table illustrating a length of the emission off duration adjusted by the driving controller 200 or the emission driver 600 of FIG. 1 according to grayscales according to some exemplary embodiments.

The display apparatus and the method of driving the display panel according to the various exemplary embodiments of FIGS. 10 and 11 are substantially the same as the display apparatus and the method of driving the display panel of the various exemplary embodiments described in association with FIGS. 1 to 7, except for the method of adjusting the length of the emission off duration. Thus, the same reference numerals will be used to refer to the same or like parts as those previously described in association with the various exemplary embodiments of FIGS. 1 to 7, and any repetitive explanation concerning the above elements will be omitted.

Referring to FIGS. 1 to 5, 10, and 11, the display apparatus includes a display panel 100 and a display panel driver. The display panel driver includes a driving controller 200, a gate driver 300, a gamma reference voltage generator 400, a data driver 500, and an emission driver 600.

The display panel 100 includes the plurality of the pixels. Each pixel includes an organic light emitting element OLED.

The pixel receives a data write gate signal (e.g., first and second data write gate signals GWP and GWN), a data initialization gate signal GI, an organic light emitting element initialization gate signal GB, the data voltage VDATA, and the emission signal EM and the organic light emitting element OLED of the pixel emits light corresponding to the level of the data voltage VDATA to display the image.

The display panel 100 may be driven in a normal driving mode in which the display panel 100 is driven in a normal driving frequency and in a low frequency driving mode in which the display panel 100 is driven in a frequency less than the normal driving frequency.

In FIGS. 4 and 5, the length of the emission off duration OD of the holding frame may be substantially the same as the length of the emission off duration OD of the writing frame in the low frequency driving mode. In this case, a lowest level LH of the luminance in the emission off duration OD of the holding frame may be different from a lowest level LW of the luminance in the emission off duration OD of the writing frame.

In some exemplary embodiments, the emission driver 600 may generate the emission signal EM having the length of the emission off duration ODW of the writing frame in which the data is written to the pixel and the length of the emission off duration ODH of the holding frame in which the data written to the pixel is maintained different from the emission off duration ODW of the writing frame in the low frequency driving mode. The emission driver 600 may output the emission signal EM having the adjusted length of the emission off duration to the display panel 100 in the low frequency driving mode. In contrast, the emission driver 600 may output the emission signal EM having uniform lengths of the emission off duration to the display panel 100 in the normal driving mode.

For example, as shown in FIG. 10, the length of the emission off duration ODW of the writing frame may be greater than the length of the emission off duration ODH of the holding frame in the low frequency driving mode.

The length of the emission off duration ODH of the holding frame of the low frequency driving mode may be adjusted to be less than the length of the emission off duration of the writing frame of the normal driving mode. The length of the emission off duration ODW of the writing frame of the low frequency driving mode may be adjusted to be greater than the length of the emission off duration of the writing frame of the normal driving mode. Thus, the lowest luminance of the writing frame of and the lowest luminance of the holding frame in the low driving frequency mode may be adjusted to be uniform. The lowest luminance of the writing frame of and the lowest luminance of the holding frame in the low driving frequency mode may be a value LM between the lowest luminance LW of the writing frame before adjustment and the lowest luminance LH of the holding frame before adjustment.

In some exemplary embodiments, the length of the emission off duration may be adjusted by the driving controller 200. In some exemplary embodiments, the length of the emission off duration may be adjusted by the emission driver 600.

As described in association with FIG. 6, only the length of the emission off duration of the holding frame is adjusted in the low frequency driving mode. As described in association with FIG. 8, only the length of the emission off duration of the writing frame is adjusted in the low frequency driving mode. According to various exemplary embodiments of FIG. 10, both the length of the emission off duration of the holding frame and the length of the emission off duration of the writing frame are adjusted in the low frequency driving mode.

As described in association with FIG. 6, the lowest luminance is greater than the lowest luminance described in association with FIG. 8 so that the display panel of FIG. 6 may display the high luminance image. As described in association with FIG. 8, the number of the frames (e.g. writing frames) having the adjusted emission off duration is less than the number of the frames (e.g. holding frames) having the adjusted emission off duration as described in association with FIG. 6 so that the reliability of the display apparatus may be enhanced and the display panel of FIG. 8 may more stably display the low luminance image than the display panel of FIG. 6.

In the various exemplary embodiments of FIG. 10, the length of the emission off duration may be properly determined considering the characteristics of the various exemplary embodiments described in association with FIG. 6 and the characteristics of the various exemplary embodiments of FIG. 8 that are in trade off relations with each other.

Referring to FIG. 11, the length of the emission off duration ODW of the writing frame and the length of the emission off duration ODH of the holding frame of the low frequency driving mode may be adjusted differently according to the grayscale of the input image. The degree of the flicker of the display panel 100 may be determined by the difference DIPA, DIPB, DIPC, DIPD, and DIPE between the lowest luminance LW of the writing frame and the lowest luminance LH of the holding frame in the low frequency driving mode. In addition, the difference DIPA, DIPB, DIPC, DIPD, and DIPE between the lowest luminance LW of the writing frame and the lowest luminance LH of the holding frame in the low frequency driving mode may vary according to the grayscale GRA, GRB, GRC, GRD, and GRE of the input image of the display panel 100.

In some exemplary embodiments, the length of the emission off duration ODHA, ODHB, ODHC, ODHD, and ODHE of the holding frame and the length of the emission off duration ODWA, ODWB, ODWC, ODWD, and ODWE of the writing frame may be adjusted to vary according to the grayscale GRA, GRB, GRC, GRD, and GRE in the low driving frequency mode.

In addition, the length of the emission off duration ODHA, ODHB, ODHC, ODHD, and ODHE of the holding frame and the length of the emission off duration ODWA, ODWB, ODWC, ODWD, and ODWE of the writing frame in the low frequency driving mode may be adjusted to vary according to the frequency of the low frequency driving mode. The degree of the flicker of the display panel 100 may be determined by the difference DIP between the lowest luminance LW of the writing frame and the lowest luminance LH of the holding frame in the low frequency driving mode. In addition, the difference DIP between the lowest luminance LW of the writing frame and the lowest luminance LH of the holding frame in the low frequency driving mode may vary according to the frequency of the low frequency driving mode.

In some exemplary embodiments, the length of the emission off duration ODH of the holding frame and the length of the emission off duration ODW of the writing frame may be adjusted to vary according to the frequency in the low driving frequency mode.

For example, when the degree of the flicker of the display panel 100 is great, the difference between the length of the writing frame of the emission off duration ODW and the length of the holding frame of the emission off duration ODH may be great. However, in some exemplary embodiments, the length of the emission off duration of the writing frame and the length of the emission off duration of the holding frame may be adjusted to be different from each other in the low frequency driving mode so that the flicker of the display panel 100 may be prevented. The flicker of the display panel 100 is prevented so that the power consumption of the display apparatus may be reduced and the display quality of the display panel 100 may be enhanced.

Figure 12:
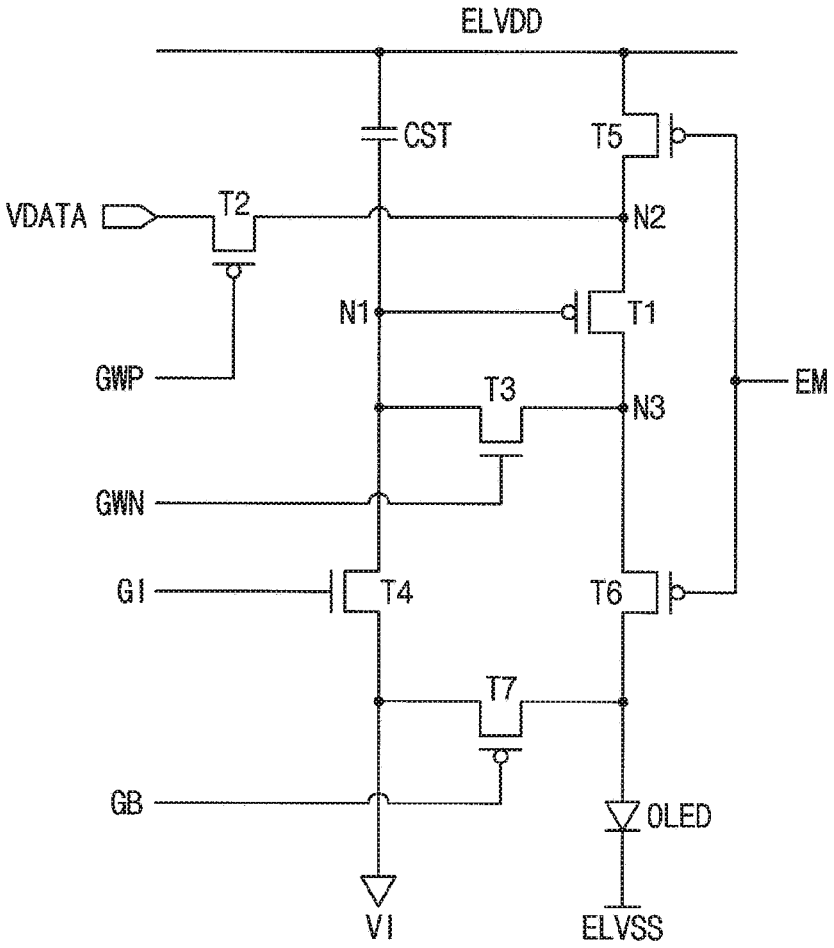
FIG. 12 is a circuit diagram illustrating a pixel of a display panel of a display apparatus according to some exemplary embodiments.
Figure 13:
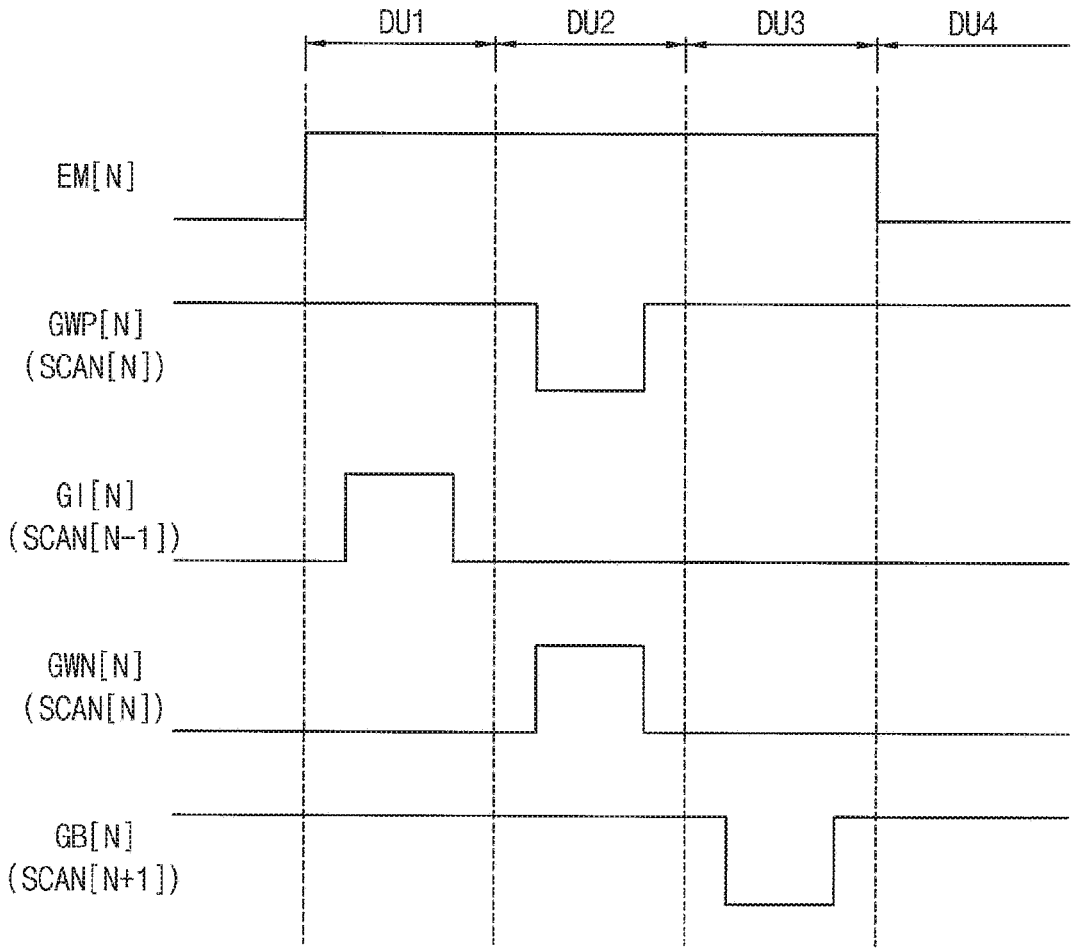
FIG. 13 is a timing diagram illustrating input signals applied to the pixel of FIG. 12 according to some exemplary embodiments.

FIG. 12 is a circuit diagram illustrating a pixel of a display panel of a display apparatus according to some exemplary embodiments. FIG. 13 is a timing diagram illustrating input signals applied to the pixel of FIG. 12 according to some exemplary embodiments.

The display apparatus and the method of driving the display panel according to the various exemplary embodiments of FIGS. 12 and 13 are substantially the same as the display apparatus and the method of driving the display panel of the various exemplary embodiments described in association with FIGS. 1 to 7, except for the pixel structure. Thus, the same reference numerals will be used to refer to the same or like parts as those previously described in association with the various exemplary embodiments of FIGS. 1 to 7, and any repetitive explanation concerning the above elements will be omitted.

Referring to FIGS. 1, 4 to 7, 12, and 13, the display apparatus includes a display panel 100 and a display panel driver. The display panel driver includes a driving controller 200, a gate driver 300, a gamma reference voltage generator 400, a data driver 500, and an emission driver 600.

The display panel 100 includes the plurality of the pixels. Each pixel includes an organic light emitting element OLED.

The pixel receives a data write gate signal (e.g., first and second data write gate signals GWP and GWN), a data initialization gate signal GI, an organic light emitting element initialization gate signal GB, the data voltage VDATA, and the emission signal EM and the organic light emitting element OLED of the pixel emits light corresponding to the level of the data voltage VDATA to display the image.

In some exemplary embodiments, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

At least one of the pixels may include first to seventh pixel switching elements T1 to T7, a storage capacitor CST, and the organic light emitting element OLED.

As seen in FIG. 12, the seventh pixel switching element T7 includes a control electrode to which the organic light emitting element initialization gate signal GB is applied, an input electrode to which the initialization voltage VI is applied, and an output electrode connected to the anode electrode of the organic light emitting element OLED. For example, the seventh pixel switching element T7 may be the polysilicon thin film transistor. For example, the seventh pixel switching element T7 may be a P-type thin film transistor.

In FIG. 13, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. During a third duration DU3, the anode electrode of the organic light emitting element OLED is initialized in response to the organic light emitting element initialization gate signal GB. During a fourth duration DU4, the organic light emitting element OLED emits the light in response to the emission signal EM so that the display panel 100 displays the image.

According to some exemplary embodiments, the active level of the organic light emitting element initialization gate signal GB may be a low level.

In some exemplary embodiments, some of the pixel switching elements may be designed using the oxide thin film transistors. As seen in FIG. 12, the third pixel switching element T3 and the fourth pixel switching element T4 may be the oxide thin film transistors. The first pixel switching element T1, the second pixel switching element T2, the fifth pixel switching element T5, the sixth pixel switching element T6, and the seventh pixel switching element T7 may be the polysilicon thin film transistors.

According to some exemplary embodiments, the emission driver 600 may generate the emission signal EM having the length of the emission off duration ODW of the writing frame in which the data is written to the pixel and the length of the emission off duration ODH of the holding frame in which the data written to the pixel is maintained different from the emission off duration ODW of the writing frame in the low frequency driving mode. The emission driver 600 may output the emission signal EM having the adjusted length of the emission off duration to the display panel 100 in the low frequency driving mode. In contrast, the emission driver 600 may output the emission signal EM having uniform lengths of the emission off duration to the display panel 100 in the normal driving mode.

According to some exemplary embodiments, the length of the emission off duration of the writing frame and the length of the emission off duration of the holding frame may be adjusted to be different from each other in the low frequency driving mode so that the flicker of the display panel 100 may be prevented. The flicker of the display panel 100 is prevented so that the power consumption of the display apparatus may be reduced and the display quality of the display panel 100 may be enhanced.

Figure 14:
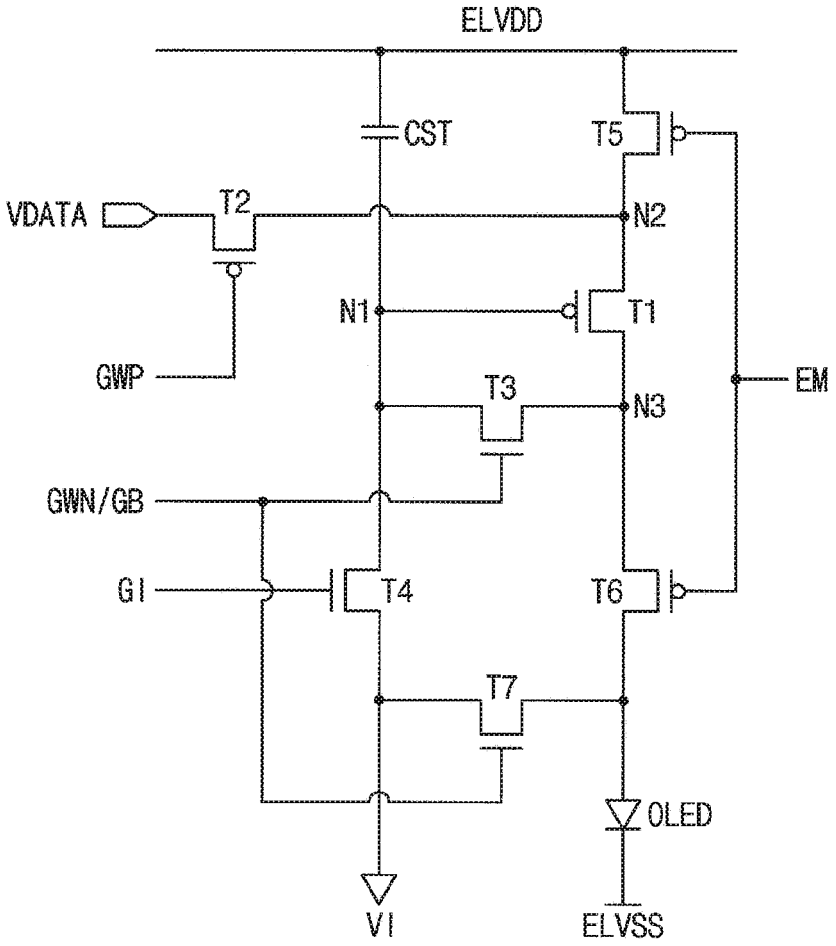
FIG. 14 is a circuit diagram illustrating a pixel of a display panel of a display apparatus according to some exemplary embodiments.
Figure 15:
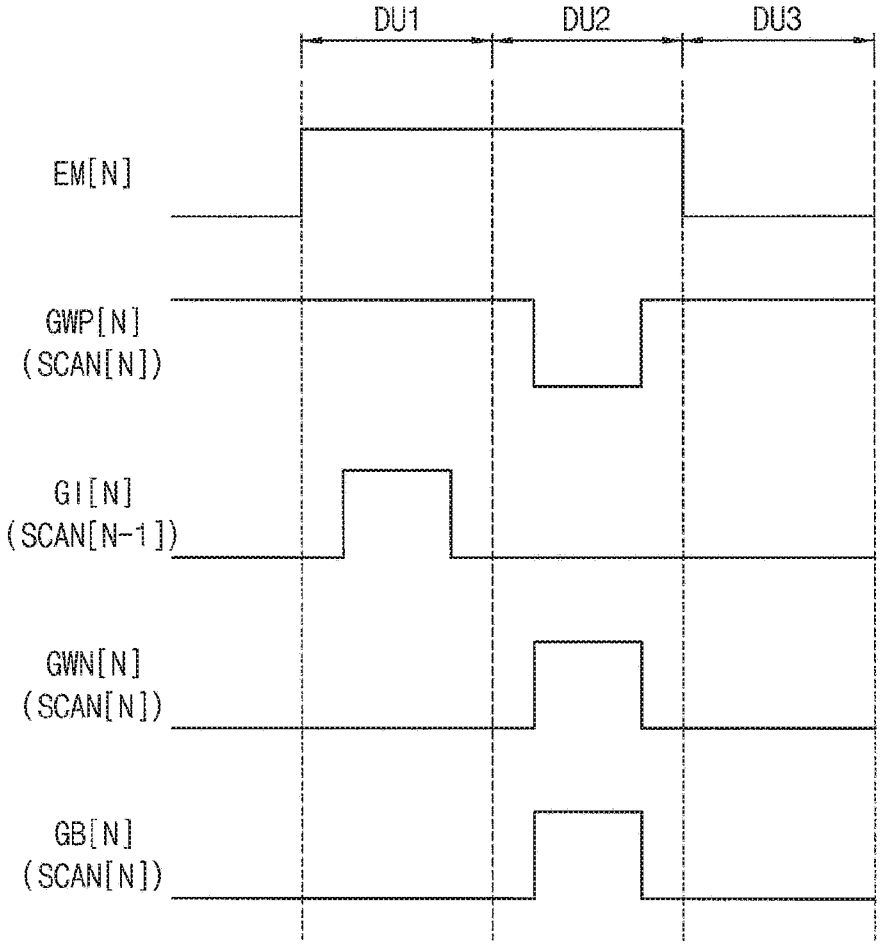
FIG. 15 is a timing diagram illustrating input signals applied to the pixel of FIG. 14 according to some exemplary embodiments.

FIG. 14 is a circuit diagram illustrating a pixel of a display panel of a display apparatus according to some exemplary embodiments. FIG. 15 is a timing diagram illustrating input signals applied to the pixel of FIG. 14 according to some exemplary embodiments.

The display apparatus and the method of driving the display panel according to the various exemplary embodiments of FIGS. 14 and 15 are substantially the same as the display apparatus and the method of driving the display panel of the various exemplary embodiments described in association with FIGS. 1 to 7, except for the pixel structure. Thus, the same reference numerals will be used to refer to the same or like parts as those previously described in association with the various exemplary embodiments of FIGS. 1 to 7, and any repetitive explanation concerning the above elements will be omitted.

Referring to FIGS. 1, 4 to 7, 14, and 15, the display apparatus includes a display panel 100 and a display panel driver. The display panel driver includes a driving controller 200, a gate driver 300, a gamma reference voltage generator 400, a data driver 500, and an emission driver 600.

The display panel 100 includes the plurality of the pixels. Each pixel includes an organic light emitting element OLED.

The pixel receives a data write gate signal (e.g., first and second data write gate signals GWP and GWN), a data initialization gate signal GI, an organic light emitting element initialization gate signal GB, the data voltage VDATA, and the emission signal EM and the organic light emitting element OLED of the pixel emits light corresponding to the level of the data voltage VDATA to display the image.

In some exemplary embodiments, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

At least one of the pixels may include first to seventh pixel switching elements T1 to T7, a storage capacitor CST, and the organic light emitting element OLED.

The third pixel switching element T3 includes a control electrode to which the second data writing gate signal GWN is applied, an input electrode connected to the first node N1, and an output electrode connected to the third node N3. For example, the third pixel switching element T3 may be the oxide thin film transistor. For example, the third pixel switching element T3 may be the N-type thin film transistor.

The seventh pixel switching element T7 includes a control electrode to which the organic light emitting element initialization gate signal GB is applied, an input electrode to which the initialization voltage VI is applied, and an output electrode connected to the anode electrode of the organic light emitting element OLED. For example, the seventh pixel switching element T7 may be the oxide thin film transistor. For example, the seventh pixel switching element T7 may be the N-type thin film transistor.

As seen in FIG. 14, the control electrode of the third pixel switching element T3 may be connected to the control electrode of the seventh pixel switching element T7. The organic light emitting element initialization gate signal GB may be the same as the second data writing gate signal GWN.

Adverting to FIG. 15, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. In addition, during the second duration DU2, the anode electrode of the organic light emitting element OLED is initialized in response to the organic light emitting element initialization gate signal GB. During a third duration DU3, the organic light emitting element OLED emits the light in response to the emission signal EM so that the display panel 100 displays the image.

According to some exemplary embodiments, some of the pixel switching elements may be designed using the oxide thin film transistors. For instance, the third pixel switching element T3, the fourth pixel switching element T4, and the seventh pixel switching element T7 may be the oxide thin film transistors. The first pixel switching element T1, the second pixel switching element T2, the fifth pixel switching element T5, and the sixth pixel switching element T6 may be the polysilicon thin film transistors.

In some exemplary embodiments, the emission driver 600 may generate the emission signal EM having the length of the emission off duration ODW of the writing frame in which the data is written to the pixel and the length of the emission off duration ODH of the holding frame in which the data written to the pixel is maintained different from the emission off duration ODW of the writing frame in the low frequency driving mode. The emission driver 600 may output the emission signal EM having the adjusted length of the emission off duration to the display panel 100 in the low frequency driving mode. In contrast, the emission driver 600 may output the emission signal EM having uniform lengths of the emission off duration to the display panel 100 in the normal driving mode.

According to some exemplary embodiments, the length of the emission off duration of the writing frame and the length of the emission off duration of the holding frame may be adjusted to be different from each other in the low frequency driving mode so that the flicker of the display panel 100 may be prevented. The flicker of the display panel 100 is prevented so that the power consumption of the display apparatus may be reduced and the display quality of the display panel 100 may be enhanced.

Figure 16:
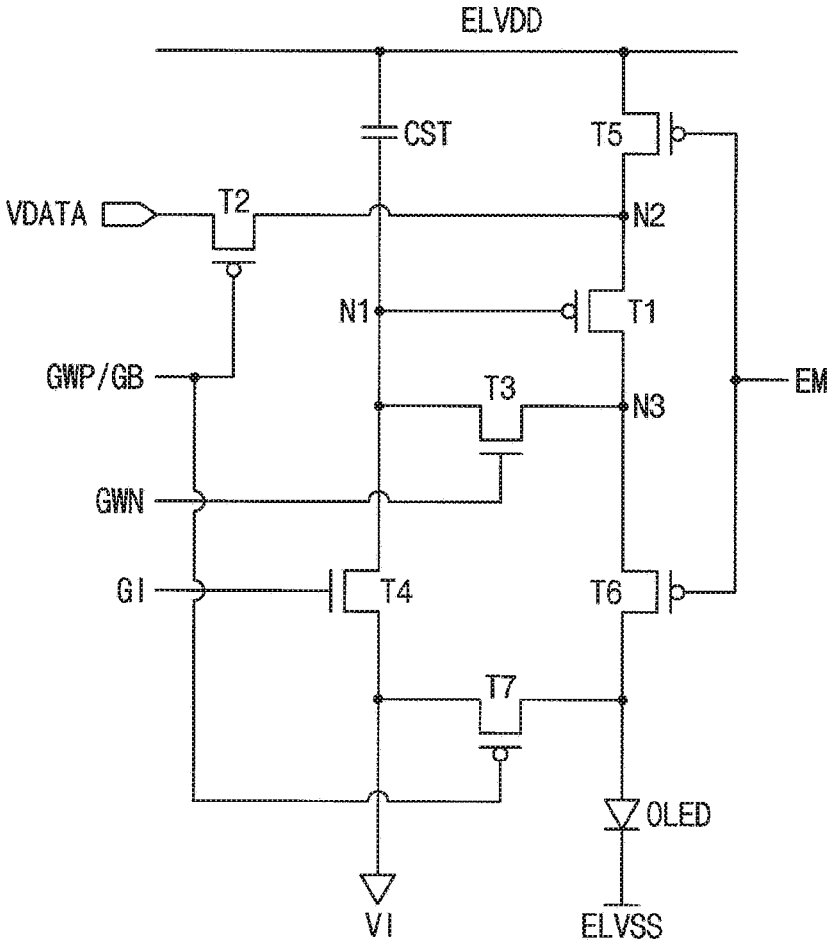
FIG. 16 is a circuit diagram illustrating a pixel of a display panel of a display apparatus according to some exemplary embodiments.
Figure 17:
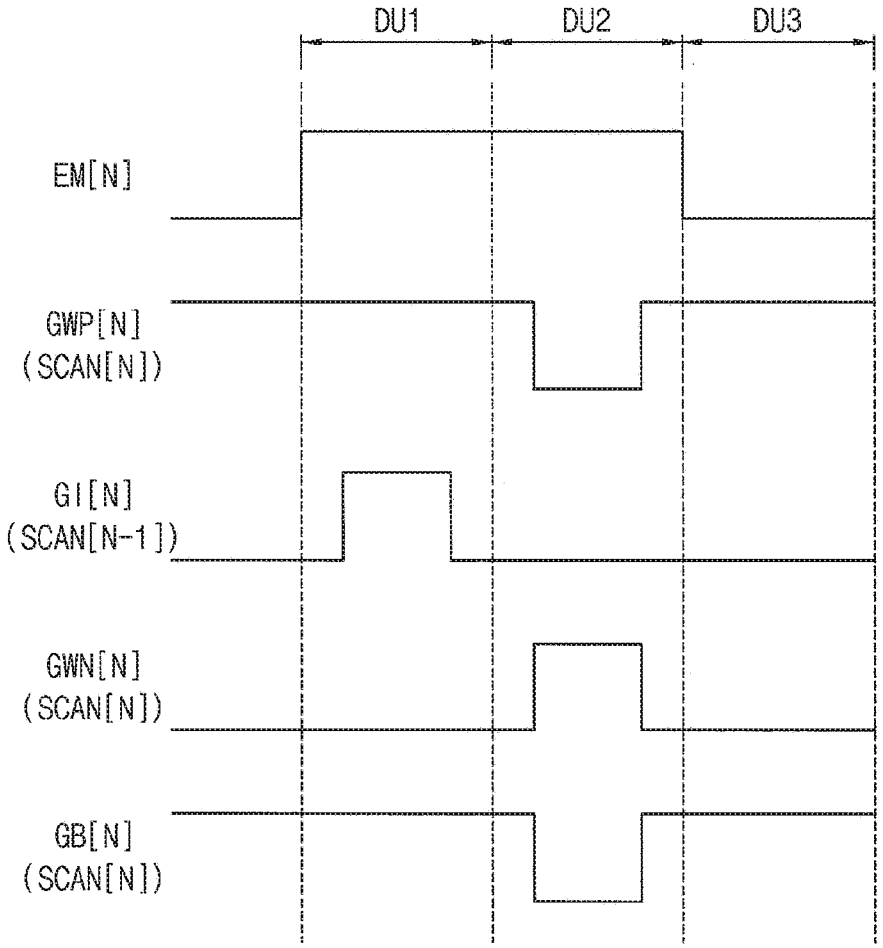
FIG. 17 is a timing diagram illustrating input signals applied to the pixel of FIG. 16 according to some exemplary embodiments.

FIG. 16 is a circuit diagram illustrating a pixel of a display panel of a display apparatus according to some exemplary embodiments. FIG. 17 is a timing diagram illustrating input signals applied to the pixel of FIG. 16 according to some exemplary embodiments.

The display apparatus and the method of driving the display panel according to the various exemplary embodiments of FIGS. 16 and 17 are substantially the same as the display apparatus and the method of driving the display panel of the various exemplary embodiments described in association with FIGS. 12 and 13, except for the pixel structure. Thus, the same reference numerals will be used to refer to the same or like parts as those previously described in association with the various exemplary embodiments of FIGS. 12 and 13, and any repetitive explanation concerning the above elements will be omitted.

Referring to FIGS. 1, 4 to 7, 14, and 15, the display apparatus includes a display panel 100 and a display panel driver. The display panel driver includes a driving controller 200, a gate driver 300, a gamma reference voltage generator 400, a data driver 500, and an emission driver 600.

The display panel 100 includes the plurality of the pixels. Each pixel includes an organic light emitting element OLED.

The pixel receives a data write gate signal (e.g., first and second data write gate signals GWP and GWN), a data initialization gate signal GI, an organic light emitting element initialization gate signal GB, the data voltage VDATA, and the emission signal EM and the organic light emitting element OLED of the pixel emits light corresponding to the level of the data voltage VDATA to display the image.

In some exemplary embodiments, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

At least one of the pixels may include first to seventh pixel switching elements T1 to T7, a storage capacitor CST, and the organic light emitting element OLED.

The second pixel switching element T2 includes a control electrode to which the first data writing gate signal GWP is applied, an input electrode to which the data voltage VDATA is applied, and an output electrode connected to the second node N2. For example, the second pixel switching element T2 may be the polysilicon thin film transistor. For example, the second pixel switching element T2 may be the P-type thin film transistor.

The seventh pixel switching element T7 includes a control electrode to which the organic light emitting element initialization gate signal GB is applied, an input electrode to which the initialization voltage VI is applied, and an output electrode connected to the anode electrode of the organic light emitting element OLED. For example, the seventh pixel switching element T7 may be the polysilicon thin film transistor. For example, the seventh pixel switching element T7 may be the P-type thin film transistor.

In some exemplary embodiments, the control electrode of the second pixel switching element T2 may be connected to the control electrode of the seventh pixel switching element T7. The organic light emitting element initialization gate signal GB may be the same as the first data writing gate signal GWP.

Adverting to FIG. 17, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. In addition, during the second duration DU2, the anode electrode of the organic light emitting element OLED is initialized in response to the organic light emitting element initialization gate signal GB. During a third duration DU3, the organic light emitting element OLED emits the light in response to the emission signal EM so that the display panel 100 displays the image.

According to some exemplary embodiments, some of the pixel switching elements may be designed using the oxide thin film transistors. For instance, the third pixel switching element T3 and the fourth pixel switching element T4 may be the oxide thin film transistors. The first pixel switching element T1, the second pixel switching element T2, the fifth pixel switching element T5, the sixth pixel switching element T6, and the seventh pixel switching element T7 may be the polysilicon thin film transistors.

In some exemplary embodiments, the emission driver 600 may generate the emission signal EM having the length of the emission off duration ODW of the writing frame in which the data is written to the pixel and the length of the emission off duration ODH of the holding frame in which the data written to the pixel is maintained different from the emission off duration ODW of the writing frame in the low frequency driving mode. The emission driver 600 may output the emission signal EM having the adjusted length of the emission off duration to the display panel 100 in the low frequency driving mode. In contrast, the emission driver 600 may output the emission signal EM having uniform lengths of the emission off duration to the display panel 100 in the normal driving mode.

According to some exemplary embodiments, the length of the emission off duration of the writing frame and the length of the emission off duration of the holding frame may be adjusted to be different from each other in the low frequency driving mode so that the flicker of the display panel 100 may be prevented. The flicker of the display panel 100 is prevented so that the power consumption of the display apparatus may be reduced and the display quality of the display panel 100 may be enhanced.

According to various exemplary embodiments, power consumption of a display apparatus may be reduced and display quality of a display panel may be enhanced.

Although certain exemplary embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A display apparatus comprising:

a display panel comprising a pixel, the pixel comprising:
- a switching element of a first type; and
- a switching element of a second type different from the first type;

a gate driver configured to output a gate signal to the display panel;

a data driver configured to output a data voltage to the display panel; and an emission driver configured to output an emission signal, the emission signal comprising:
- a length of an emission off duration of a writing frame in which data is written to the pixel; and
- a length of an emission off duration of a holding frame in which the data written to the pixel is maintained in a low frequency driving mode, the length of the emission off duration of the holding frame being different from the length of the emission off duration of the writing frame in the low frequency driving mode, wherein the length of the emission off duration of the writing frame is greater than the length of the emission off duration of the holding frame in the low frequency driving mode.

2. The display apparatus of claim 1, wherein:

in a normal driving mode, the display panel is configured to be driven in a frequency greater than a frequency of the low frequency driving mode;

the normal driving mode only comprises writing frames, the writing frames comprising the writing frame;

a length of the emission off duration of the writing frame in the low frequency driving mode is substantially the same as a length of the emission off duration of the writing frame in the normal driving mode; and the length of the emission off duration of the holding frame in the low frequency driving mode is less than the length of the emission off duration of the writing frame in the normal driving mode.

3. The display apparatus of claim 2, wherein the length of the emission off duration of the holding frame in the low frequency driving mode is adjusted to vary according to grayscales of an input image.

4. The display apparatus of claim 2, wherein the length of the emission off duration of the holding frame in the low frequency driving mode is adjusted to vary according to the frequency of the low frequency driving mode.

5. The display apparatus of claim 1, wherein:

in a normal driving mode, the display panel is configured to be driven in a frequency greater than a frequency of the low frequency driving mode;

the normal driving mode only comprises writing frames, the writing frames comprising the writing frame;

a length of the emission off duration of the writing frame in the low frequency driving mode is greater than a length of the emission off duration of the writing frame in the normal driving mode; and the length of the emission off duration of the holding frame in the low frequency driving mode is substantially the same as the length of the emission off duration of the writing frame in the normal driving mode.

6. The display apparatus of claim 5, wherein the length of the emission off duration of the writing frame in the low frequency driving mode is adjusted to vary according to grayscales of an input image.

7. The display apparatus of claim 5, wherein the length of the emission off duration of the writing frame in the low frequency driving mode is adjusted to vary according to the frequency of the low frequency driving mode.

8. The display apparatus of claim 1, wherein:

in a normal driving mode, the display panel is configured to be driven in a frequency greater than a frequency of the low frequency driving mode;

the normal driving mode only comprises writing frames, the writing frames comprising the writing frame;

a length of the emission off duration of the writing frame in the low frequency driving mode is greater than a length of the emission off duration of the writing frame in the normal driving mode; and the length of the emission off duration of the holding frame in the low frequency driving mode is less than the length of the emission off duration of the writing frame in the normal driving mode.

9. The display apparatus of claim 8, wherein:

the length of the emission off duration of the writing frame in the low frequency driving mode is adjusted to vary according to grayscales of an input image; and the length of the emission off duration of the holding frame in the low frequency driving mode is adjusted to vary according to the grayscales of the input image.

10. The display apparatus of claim 8, wherein:

the length of the emission off duration of the writing frame in the low frequency driving mode is adjusted to vary according to the frequency of the low frequency driving mode; and the length of the emission off duration of the holding frame in the low frequency driving mode is adjusted to vary according to the frequency of the low frequency driving mode.

11. The display apparatus of claim 1, wherein:

the switching element of the first type is a polysilicon thin film transistor; and the switching element of the second type is an oxide thin film transistor.

12. The display apparatus of claim 11, wherein:

the switching element of the first type is a P-type transistor; and the switching element of the second type is an N-type transistor.

13. The display apparatus of claim 11, wherein the pixel comprises:

a first pixel switching element comprising a control electrode connected to a first node, an input electrode connected to a second node, and an output electrode connected to a third node;

a second pixel switching element comprising a control electrode configured to receive a first data write gate signal, an input electrode configured to receive the data voltage, and an output electrode connected to the second node;

a third pixel switching element comprising a control electrode configured to receive a second data write gate signal, an input electrode connected to the first node, and an output electrode connected to the third node;

a fourth pixel switching element comprising a control electrode configured to receive a data initialization gate signal, an input electrode configured to receive an initialization voltage; and an output electrode connected to the first node;

a fifth pixel switching element comprising a control electrode configured to receive the emission signal, an input electrode configured to receive a high power voltage; and an output electrode connected to the second node;

a sixth pixel switching element comprising a control electrode configured to receive the emission signal, an input electrode connected to the third node, and an output electrode connected to an anode electrode of an organic light emitting element;

a seventh pixel switching element comprising a control electrode configured to receive an organic light emitting element initialization gate signal, an input electrode configured to receive the initialization voltage, and an output electrode connected to the anode electrode of the organic light emitting element;

a storage capacitor comprising a first electrode configured to receive the high power voltage and a second electrode connected to the first node; and the organic light emitting element comprising the anode electrode connected to the output electrode of the sixth switching element and a cathode electrode configured to receive a low power voltage.

14. The display apparatus of claim 13, wherein:

the first pixel switching element, the second pixel switching element, the fifth pixel switching element, and the sixth pixel switching element are polysilicon thin film transistors; and the third pixel switching element, the fourth pixel switching element, and the seventh pixel switching element are oxide thin film transistors.

15. The display apparatus of claim 14, wherein the control electrode of the third pixel switching element is connected to the control electrode of the seventh pixel switching element.

16. The display apparatus of claim 13, wherein:

the first pixel switching element, the second pixel switching element, the fifth pixel switching element, the sixth pixel switching element, and the seventh pixel switching element are polysilicon thin film transistors; and the third pixel switching element and the fourth pixel switching element are oxide thin film transistors.

17. The display apparatus of claim 16, wherein the control electrode of the second pixel switching element is connected to the control electrode of the seventh pixel switching element.

18. The display apparatus of claim 13, wherein:

the second data writing gate signal and the data initialization gate signal have a first frequency; and the first data writing gate signal, the emission signal, and the organic light emitting element initialization gate signal have a second frequency greater than the first frequency.

19. A method of driving a display panel, the method comprising:

outputting a first data writing gate signal to a display panel;

outputting a second data writing gate signal to the display panel simultaneously with the first data writing gate signal;

outputting a data voltage to the display panel; and outputting an emission signal to the display panel, wherein the display panel comprises a pixel, the pixel comprising:

a switching element of a first type; and a switching element of a second type different from the first type, wherein the emission signal comprises:

a length of an emission off duration of a writing frame in which data is written to the pixel; and a length of an emission off duration of a holding frame in which the data written to the pixel is maintained in a low frequency driving mode, and wherein the length of the emission off duration of the writing frame is greater than the length of the emission off duration of the holding frame in the low frequency driving mode.

20. The method of claim 19, wherein the length of the emission off duration of the writing frame or the length of the emission off duration of the holding frame in the low frequency driving mode is adjusted to vary according to grayscales of an input image.

21. The method of claim 19, wherein the length of the emission off duration of the writing frame or the length of the emission off duration of the holding frame in the low frequency driving mode is adjusted to vary according to the frequency of the low frequency driving mode.

* * * * *